US007669356B2

(12) United States Patent
Joannes et al.

(10) Patent No.: US 7,669,356 B2
(45) Date of Patent: Mar. 2, 2010

(54) DEVICE FOR DETECTING AND COUNTING SHOTS FIRED BY AN AUTOMATIC OR SEMI-AUTOMATIC FIREARM, AND FIREARM EQUIPPED WITH SUCH A DEVICE

(75) Inventors: René Joannes, Herve (BE); Jean-Paul Delcourt, Grâce-Hollogne (BE); Patrick Heins, Liège (BE)

(73) Assignee: FN Herstal, Societe Anonyme, Herstal (BE)

( * ) Notice: Subject to any disclaimer, the term of this patent is extended or adjusted under 35 U.S.C. 154(b) by 0 days.

(21) Appl. No.: 11/589,071

(22) Filed: Oct. 30, 2006

(65) Prior Publication Data

US 2008/0016744 A1 Jan. 24, 2008

(30) Foreign Application Priority Data

Jul. 18, 2006 (BE) ..... 2006/0396

(51) Int. Cl.
*F41A 9/53* (2006.01)

(52) U.S. Cl. ..... 42/1.01; 42/1.03

(58) Field of Classification Search ..... 42/1.01, 42/1.02, 1.03, 1.05
See application file for complete search history.

(56) References Cited

U.S. PATENT DOCUMENTS

| | | | | |
|---|---|---|---|---|
| 3,090,914 | A * | 5/1963 | Kabak | 368/114 |
| 3,792,638 | A * | 2/1974 | Cox et al. | 89/14.05 |
| 4,001,961 | A * | 1/1977 | Johnson et al. | 42/1.03 |
| 4,102,074 | A * | 7/1978 | Andre | 42/1.03 |
| 5,033,217 | A * | 7/1991 | Brennan | 42/1.01 |

(Continued)

FOREIGN PATENT DOCUMENTS

| | | |
|---|---|---|
| DE | 40 22 038 A1 | 1/1992 |

(Continued)

*Primary Examiner*—Stephen M Johnson
*Assistant Examiner*—Daniel J Troy
(74) *Attorney, Agent, or Firm*—Bacon & Thomas, PLLC

(57) ABSTRACT

Device for detecting and counting shots fired by an automatic or semi-automatic fire arm with a barrel and moving parts to recock the fire arm, sliding in the axial direction (Y-Y') of the barrel between a front position and a rear position, whereby the fire arm undergoes accelerations in the axial direction (Y-Y') of the barrel for every fired shot, caused by a succession of shocks due to the shot being fired and to the movements of the moving parts, whereby the progression in time of the accelerations is typical for a fire arm and for the type of ammunition used, thus forming a typical signature for the fire arm and for the type of ammunition, characterized in that it comprises an accelerometer (2) with a pass band which is sensitive to shocks in the axial direction (Y-Y') of the barrel and a microprocessor (3) for analyzing the signal (S) of the accelerometer (2) while firing, whereby the microprocessor (3) is equipped with an algorithm to count the number of shots fired, based on the discernment and recording of a shot being fired on the basis of the detection, in the signal of the accelerometer, of all or part of the characteristic elements of the acceleration signature which is typical of the type of fire arm and of the different types of ammunition used, whereby these characteristic elements are recorded beforehand in a memory (4) of the device.

21 Claims, 6 Drawing Sheets

U.S. PATENT DOCUMENTS

| | | | | |
|---|---|---|---|---|
| 5,142,805 | A * | 9/1992 | Horne et al. | 42/1.02 |
| 5,406,730 | A * | 4/1995 | Sayre | 42/1.02 |
| 5,566,486 | A * | 10/1996 | Brinkley | 42/1.02 |
| 5,827,991 | A | 10/1998 | Predazzer | |
| 6,305,941 | B1 * | 10/2001 | Kotsiopoulos et al. | 434/11 |
| 6,643,968 | B2 * | 11/2003 | Glock | 42/1.02 |
| 6,785,996 | B2 * | 9/2004 | Danner et al. | 42/70.08 |
| 6,948,487 | B2 * | 9/2005 | Rice et al. | 124/32 |
| 7,100,437 | B2 * | 9/2006 | Johnson et al. | 73/167 |
| 7,143,644 | B2 * | 12/2006 | Johnson et al. | 73/167 |
| 7,234,260 | B2 * | 6/2007 | Acarreta | 42/1.02 |
| 2003/0061753 | A1 * | 4/2003 | Glock | 42/1.02 |
| 2005/0114084 | A1 * | 5/2005 | Johnson et al. | 702/183 |
| 2005/0155420 | A1 * | 7/2005 | Johnson et al. | 73/167 |
| 2006/0042142 | A1 * | 3/2006 | Sinha | 42/1.01 |
| 2006/0053671 | A1 * | 3/2006 | Weinberger | 42/1.01 |
| 2006/0096144 | A1 * | 5/2006 | Delgado Acarreta | 42/1.01 |

FOREIGN PATENT DOCUMENTS

| | | | |
|---|---|---|---|
| DE | 44 17 545 | A1 | 11/1995 |
| DE | 10 2005 011 218 | A1 | 9/2005 |
| EP | 1 300 648 | A1 | 4/2003 |

* cited by examiner

DEVICE FOR DETECTING AND COUNTING SHOTS FIRED BY AN AUTOMATIC OR SEMI-AUTOMATIC FIREARM, AND FIREARM EQUIPPED WITH SUCH A DEVICE

The invention concerns a device for detecting and counting shots fired by an automatic or semi-automatic firearm and a firearm equipped with such a device.

From the fighter's point of view, one of the most essential characteristics of the firearm is its availability, i.e. its capacity to be fully operational during operations. This implies not only that the firearm must be liable, but that it is also subjected to an appropriate preventive maintenance whereby the manner in which the firearm has been used is taken into account.

Indeed, an automatic or semi-automatic firearm contains moving parts which are subject to wear and tear during the life of the firearm, and which may thus interrupt the firing if the firearm is not maintained in a regular and preventive manner.

The moving parts of a firearm carry out a to-and-fro movement in the axial direction of the barrel between a front position and a rear position, whereby this movement allows for the recock while firing, i.e. the extraction out of the chamber of the fired cartridge casing, its ejection, followed by the introduction of a new cartridge in the empty chamber, either in semi-automatic mode, also called in rapid succession, or in burst mode.

This sequence of operations may also be carried out in another order, i.e. introduction of a new cartridge in the empty chamber, firing of the ammunition, extraction of the fired cartridge casing out of the chamber and ejection.

This to-and-fro movement usually takes place in a direction which is parallel to the axis of the barrel of the firearm.

The energy which provokes the recoil movement is supplied by the device which activates the mechanism, the latter being either a gas intake mechanism or a short recoil mechanism of the barrel, or also a long recoil mechanism of the barrel, or a mechanism of the 'blowback' type or 'retarded blowback' type, whereby this list is not limitative.

The energy provoking the return movement of the mechanism is supplied by a return spring which is compressed during the recoil phase.

The wear of the firearm and thus the maintenance to be provided mainly depend on the to-and-fro movements of the moving parts and thus on the conditions of use of the firearm, such as the number of shots fired and the firing conditions as well as the rate of fire.

That is why it is important for the firearm to have a 'black box' which detects and registers said conditions of use.

Several methods and devices have already been suggested to detect and register the shots fired by a firearm.

The method of U.S. Pat. No. 5,033,217 is based on the use of a control element to assess the number of shots fired by an arm in a visual manner.

Thus, there is no actual counting, but merely a visualization, without any further indications about the use of the firearm, in particular regarding the firing conditions it has been subjected to.

U.S. Pat. No. 5,566,486 and US patent application 2005/114084 describe devices for counting the shots fired, based on the detection of the impulse of the recoil shock of the firearm, by mechanical or electronic sensors respectively.

These known devices that react to shocks reaching a level which is supposed to correspond to the recoil of the firearm when firing have two major disadvantages:

- the recoil depends, in particular, on the weight of the firearm and of the shooter; or the weight of the firearm varies as a function of the accessories with which it is provided and it may be doubled if a grenade launcher, a firing control system and a scope are added to it.
- the used devices do not take into account the blanks firings, by distinguishing them, which are frequent in the life of the firearm and which provoke specific sorts of wear, since these shots or not detected as the recoil level is insufficient.

Moreover, these known devices register a shot being fired, without any further information about the kinematic behavior of the firearm while firing, so that one can only form an idea about the preventive maintenance requirements for the firearm.

The invention aims to avoid one or several of these disadvantages.

The principle of the invention is based on the finding that, when firing, for every fired shot, the firearm experiences accelerations in the axial direction of the barrel, whereby these accelerations are due to a succession of shocks produced when a shot is fired and caused by the to-and-fro movements of the moving parts, and the finding that the progression in time of the accelerations is typical for a firearm and for the type of ammunition used, thus forming a typical signature for the firearm and for the type of fired ammunition.

The aim of the invention is reached with a device for detecting and counting shots fired by an automatic or semi-automatic firearm, which comprises an accelerometer with a pass band which is sensitive to shocks in the axial direction of the barrel and a microprocessor for analyzing the signal of the accelerometer while firing, whereby the microprocessor is equipped with an algorithm to count the number of shots fired, based on the discernment and recording of a shot being fired on the basis of the detection, in the signal of the accelerometer, of all or part of the characteristic elements of the acceleration signature which is typical of the type of firearm and of the different types of ammunition used, whereby these characteristic elements are recorded beforehand in a memory of the device.

The use of the accelerometer makes it possible to perform a detailed analysis of the acceleration phenomena occurring in the firearm while firing, independently of the recoil level of the firearm, and thus of the different factors that have an effect on the latter.

According to a preferred embodiment, the algorithm makes it possible to distinguish the type of ammunition used depending on whether at least a part of or certain characteristic elements of the acceleration signature have occurred which correspond to the signature of the type of ammunition used, for example in order to discern blanks from live ammunitions, taking into account the direction of the first initial shock.

According to another preferred characteristic, the device makes it possible to measure and to memorize the time interval between the first and the second shock, whereby this interval corresponds to the time of the recoil of the moving parts of the firearm.

The thus registered time of the recoil provides important information about the behavior of the firearm and the quality of its adjustment, thus allowing for a diagnosis and/or adjustment of the firearm.

The invention also concerns an automatic or semi-automatic firearm equipped with a device according to the invention.

In order to further illustrate the invention, the following examples of embodiments of a device according to the invention for detecting and counting shots fired by an automatic or semi-automatic firearm are described hereafter by way of example only and without being limitative in any way, with reference to the accompanying drawings, in which:

FIG. 1 schematically represents a device according to the invention for detecting and counting shots fired by an automatic or semi-automatic firearm;

Figure 1:
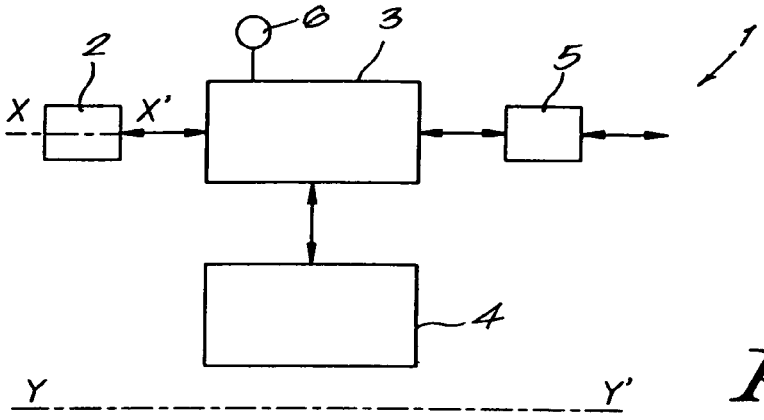
FIG. 1 shows an example of a device 1 according to the invention.

The device 1 is a 'black box' so to say, designed to be mounted on or to be integrated in a firearm and it is formed of:

- an accelerometer 2, preferably with a single axis, positioned such that the axis of detection (X-X') is parallel to the axis (Y-Y') of the barrel when the device 1 is fixed on or in the firearm;
- a microprocessor 3 whose program comprises an algorithm to discern and register a shot being fired;
- a memory 4 in which the information is stored, the memory 4 being preferably a permanent memory which stays operational even in case of a power supply interruption and which can be integrated in the microprocessor 3 and which may possibly contain the identification number of the firearm in a permanent and ineffaceable manner, which guarantees the traceability of the latter;
- a communication interface 5, preferably without any contacts, for example of the radio type (Bluetooth or ZigBee for example) or infrared type, or of the RFID type; of course it may be bidirectional and it allows to register external data in the memory 4, regarding for example maintenance operations carried out on the firearm;
- an energy source 6, for example a dry cell or a rechargeable battery.

The device 1 is preferably small and it can thus be easily integrated in most firearms, for example in the grip of the latter.

The components 1 to 6 can be mounted as a whole on one and the same board, whereby the device 1 then forms a stand-alone module which does not need to be connected anywhere inside the firearm.

The working principle of the device 1 is based on the use of an accelerometer 2 with an appropriate pass band and a particular algorithm for processing the signal supplied by said accelerometer which detects and analyses in that signal the events linked to the kinematic phenomena that occur when firing, such that it can be determined with certainty whether a shot has been fired and such that it becomes possible to discern between a blank and a live cartridge, whereby shocks due to falls, recocks or releases are excluded, whereby parameters can be set for said algorithm and these parameters can be adjusted as a function of the characteristics of the type of firearm concerned.

Figure 2:
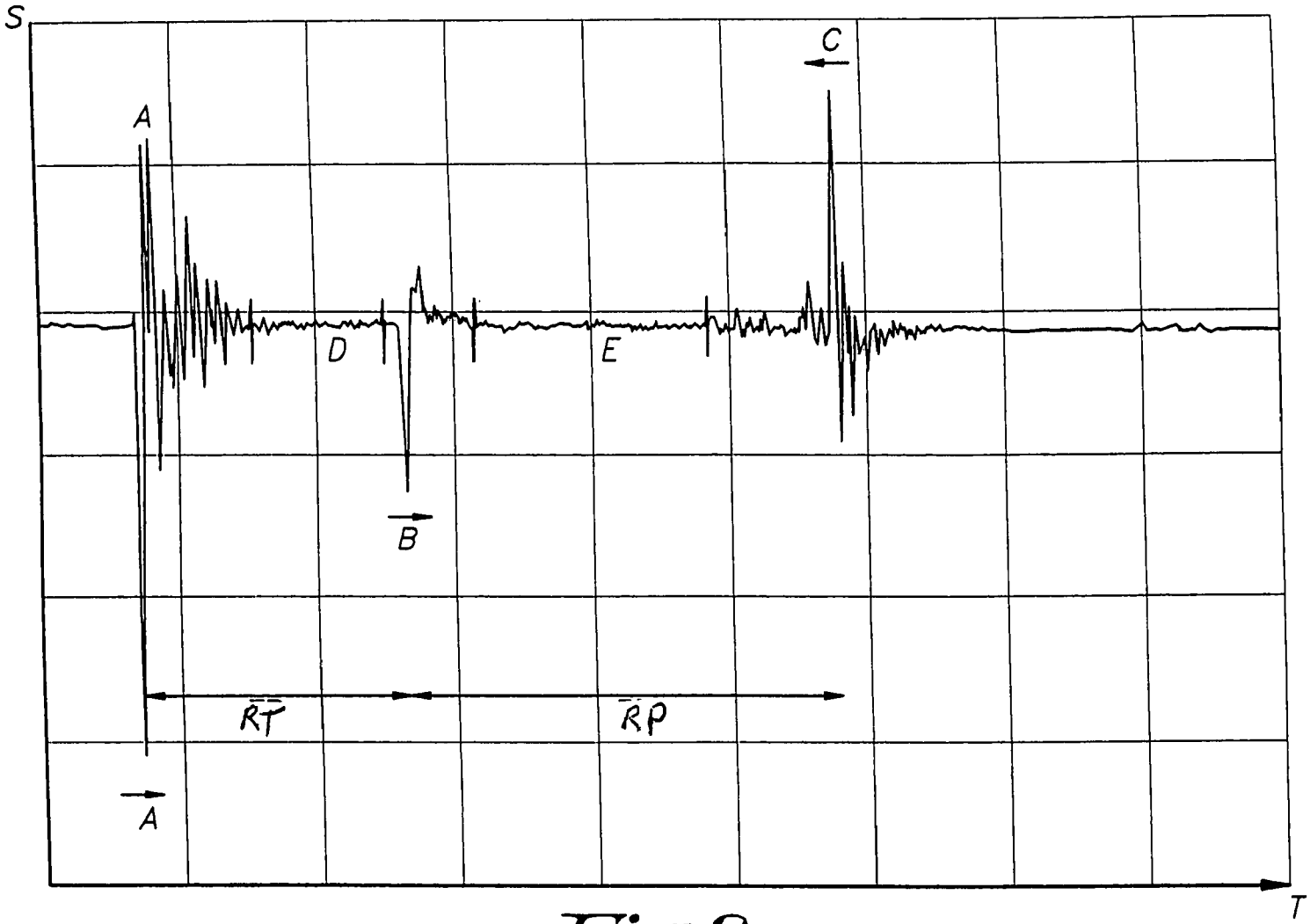
FIG. 2 represents the diagram of the signal of an accelerometer of the device in FIG. 1, as a function of time while firing.

FIG. 2 shows how signal S is registered as a function of time T when a live cartridge is fired with a particular type of firearm, by an accelerometer having a pass band in the order of 400 Hz.

FIG. 2 in particular shows a firearm of the 'firing with locked bolt' type, whose to-and-fro sequence of the moving parts is as follows:

- moving parts initially in front position with ammunition in chamber;
- preparing ammunition and a shot is fired;
- recoil phase of the moving parts;
- possibly comes to an abutment in the rear or makes contact with end of course shock absorber;
- return phase and supply of new ammunition;
- moving parts come to an abutment in front position.

We distinguish this succession of events in signal S in FIG. 2:

- a first shock towards the rear of the firearm when the shot is fired, represented by arrow A;
- recoil time (RT) of the moving parts towards the back;
- a second shock towards the rear as well of the firearm when the moving parts come to an abutment in the rear at the end of the recoil movement of these moving parts towards the rear, as represented by arrow B;
- return phase (RP) with new ammunition being supplied;
- a third shock towards the front when the moving parts make contact with a front abutment when the chamber of the barrel is closed, as represented by arrow C;
- two "calm" zones D and E which separate the shocks A, B and C from one another and in which the acceleration level is practically zero.

The time between the three shocks, as well as the duration of the three "calm zones" D and E are situated within ranges that are characteristic of that type of firearm, whereby the specific values of said time periods for a given firearm are influenced by the setting of the firearm and in how far it is oiled and used.

Thus, the signal S so to say is the signature of the firearm.

Figure 3:
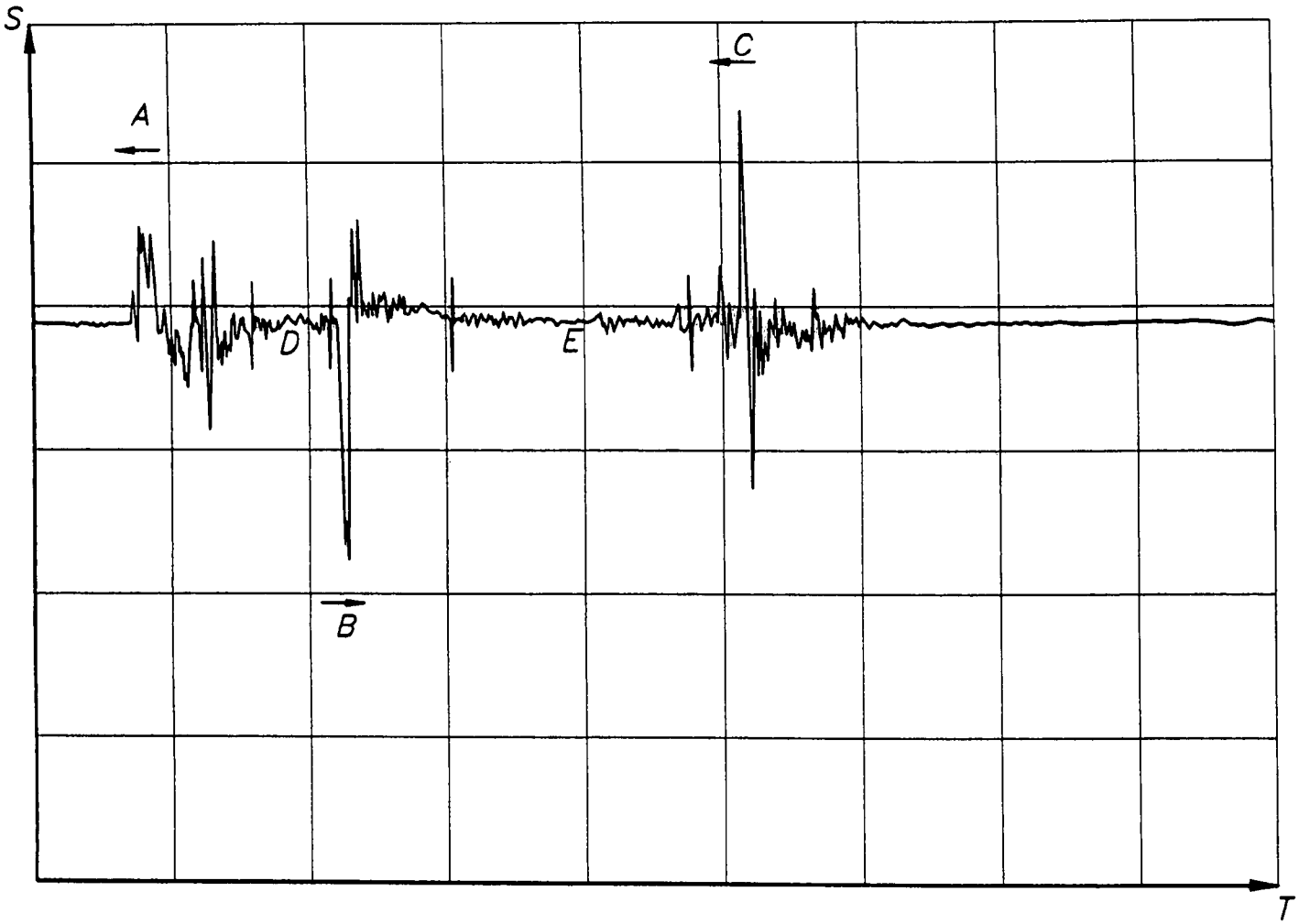
FIGS. 3 and 4 are diagrams similar to those in FIG. 2.

FIG. 3 shows signal S, produced by the accelerometer 2, under the same conditions, but when a blank is fired with the same firearm.

We see the same succession of events A to E as when firing live cartridges, with this difference that the initial impulse A is weaker and in the opposite direction.

The algorithm to discern and register whether a shot has been fired consists in analyzing in the signal S supplied by the accelerometer 2 whether all or part of the events A to E are present in order to conclude whether a shot has been fired.

Figure 4:
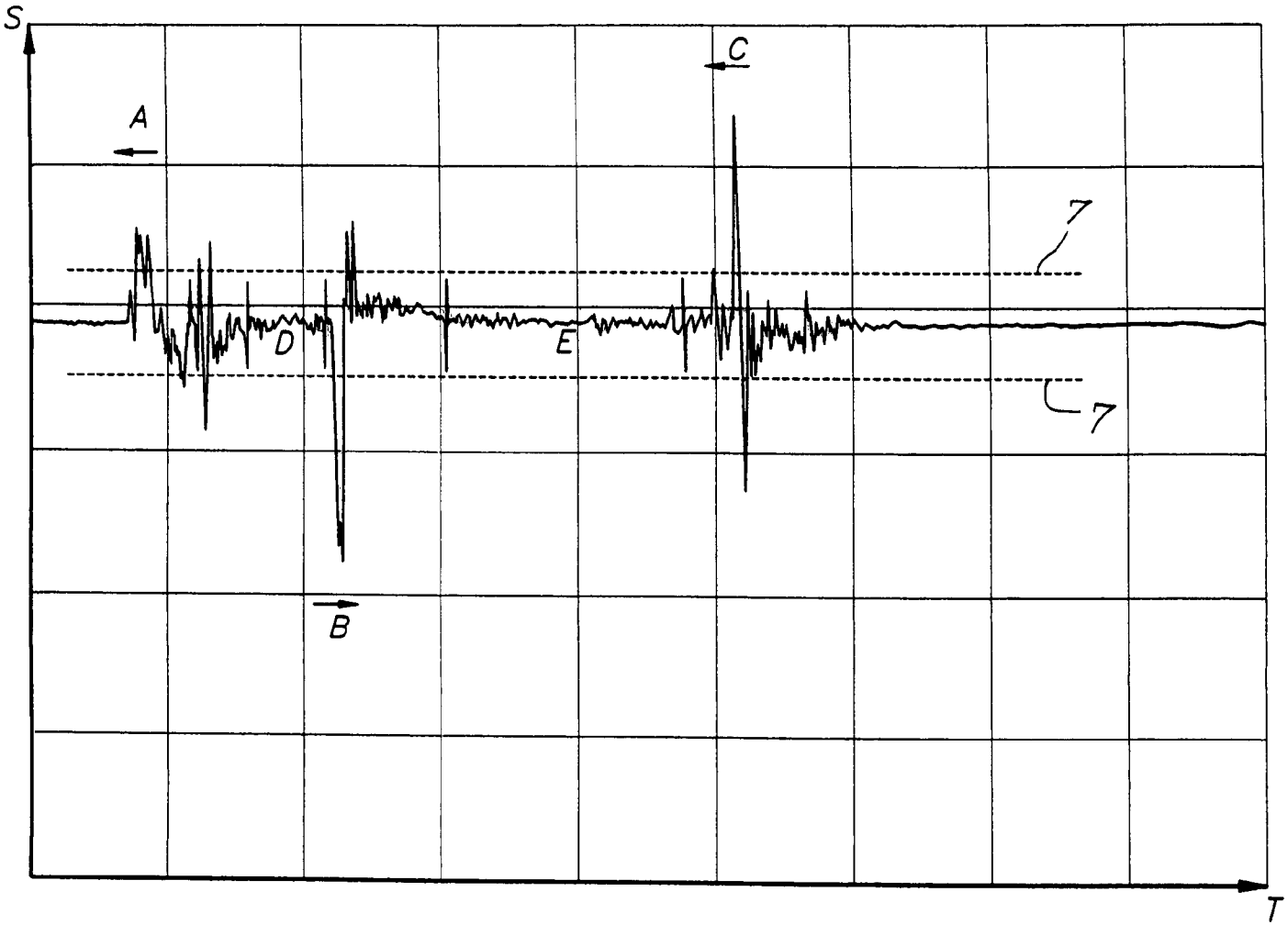

The activation of the algorithm can depend, for example, on the finding that a threshold 7 has been crossed by the signal S of the accelerometer 2, as indicated in FIG. 4.

In a particular embodiment of the algorithm, the direction of the initial impulse A is used to determine whether a blank cartridge or live cartridge has been fired.

A preferred embodiment of the device 1 takes the intervals between the three shocks A, B and/or C into account, as well as the duration of the "calm zones" D and/or E which, in order to be accepted as criteria to determine whether a shot has been fired, must be situated within plausible time ranges, typical for the type of firearm concerned, whereby these ranges are programmable parameters of the algorithm.

It should be noted that the second shock B caused by the rear abutment of the moving parts may either not exist or may be too weak to be taken into account; the absence of this second shock B generally indicates a setting error and a restricted functioning of the firearm, whereby a insufficient amount of energy is recycled by the moving parts to guarantee the recock of the firearm.

On the other hand, a shock B situated at a level which is too high, due to too much energy being recycled at the level of the moving parts, indicates a bad setting of the firearm which may result in excessive wear or elements being broken.

Thus, the measurement of the level of this second shock B is representative for the kinematic behavior of the firearm. In order to be no longer dependant on exterior factors, such as the weight of accessories fixed on the firearm or the way in which the firearm is held while firing, which may affect the absolute level of the different shocks, it is advantageous to base oneself, not on the absolute level of shock B, but on the relationship between the measurement of this second shock B and that of shocks A and/or C.

According to a specific embodiment of the process, the "lack of recoil", i.e. the absence of the second shock B while firing, is memorized as a particular event associated with said firing, which indicates a bad functioning of the firearm.

The recoil time RT of the moving parts, characterized by the interval between the first shock A and the second shock B as indicated in FIG. 1, is a representative parameter as well for the kinematic behavior of the firearm.

In another particular embodiment of the device 1 according to the invention, this parameter is measured and memorized so as to allow for a diagnosis and/or adjustment of the firearm.

Moreover, the microprocessor 3 can, based for example on its internal clock, measure the interval between two shots that are fired, and thus determine the bursts and their lengths, i.e. identify the firing conditions which are determinative as far as the wear of the elements is concerned. It can also measure the rates when firing by bursts.

This capacity may be used to indicate the shooter in real time that he/she has reached the permissible firing conditions for the firearm when firing by bursts or that he/she has exceeded it.

In another specific embodiment of the device 1 according to the invention, the maximum level of the signal produced by the shock B is measured and memorized so as to allow for the diagnosis and/or the adjustment of the firearm.

In another specific embodiment of the device 1 according to the invention, the relation between the maximum level of the signal produced by the shock B and the maximum level of the initial shock A and/or the maximum level of the closing shock C is calculated and memorized so as to allow for the diagnosis and/or the adjustment of the firearm.

Figure 5:
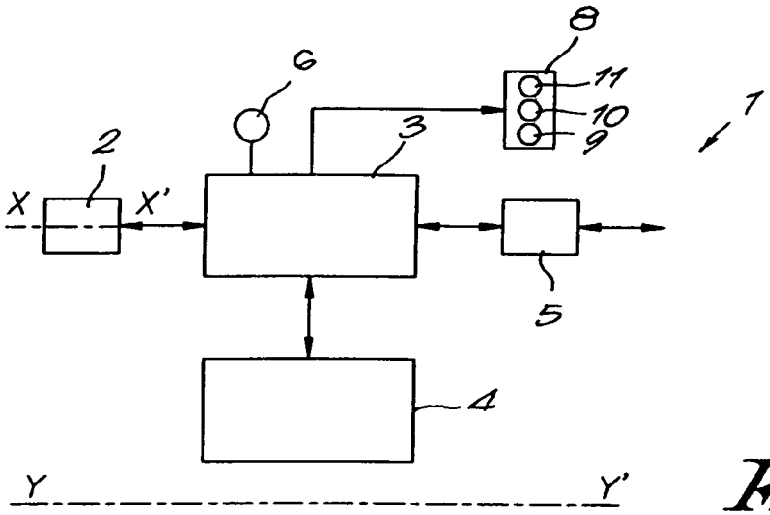
FIGS. 5 to 12 are all variants of a device according to the invention and FIG. 13 illustrates a few of the components of a firearm.

FIG. 5 illustrates a special embodiment of the device which makes use of that possibility: when the microprocessor 3 detects bursts that last too long, it warns the shooter via an appropriate display 8, consisting, for example, of a set of light indicators 9, 10, 11 in different colors, whereby the green indicator 9 indicates a normal use, the orange indicator 10 indicates a restricted use and the red indicator 11 indicates a potentially dangerous situation.

Such a function is particularly useful in the case of machine guns.

Figure 6:
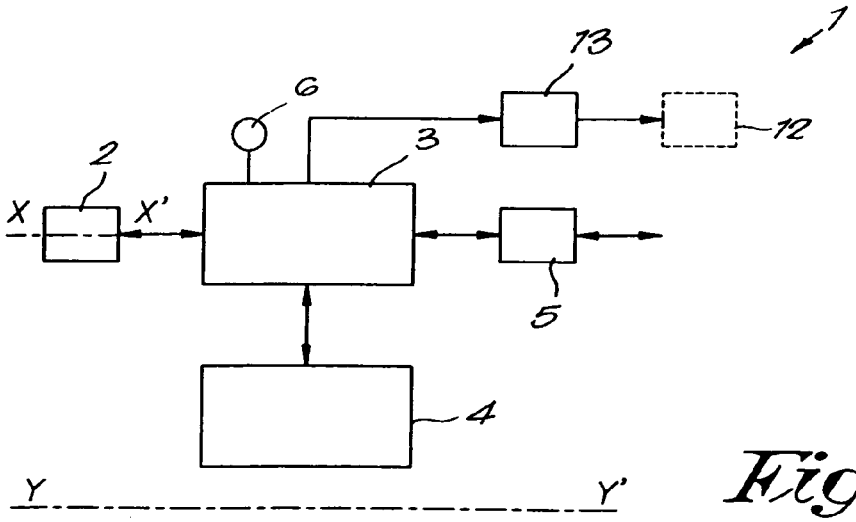

The ability of the device 1 to continuously keep track of the firing conditions may also be used to act directly on the mechanism of the firearm 12, via a mechanical interface or an actuator 13 as indicated in FIG. 6, and to modify its operation mode, for example by provoking the transition from firing with a locked bolt to firing with an open bolt (see for example Belgian patent No. 1,001,909), in order to prevent a spontaneous ignition of the ammunition in the chamber.

To this end, one only has to register a table or a chart in the memory 4 of the microprocessor 5 which defines, as a function of the length of the shots, the number of shots fired on the basis of which the operation mode of the firearm must be commutated.

Figure 7:
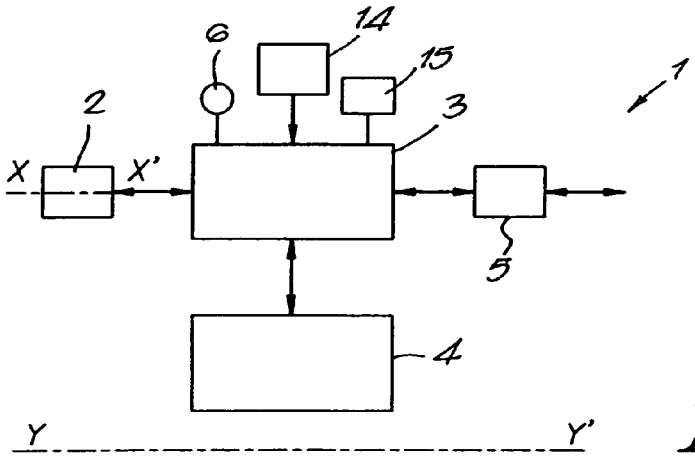

As represented in FIG. 7, a real-time clock 14 may be included in the device 1 which makes it possible for the microprocessor 3 to register in the memory 4 the exact and complete date of every fired shot.

One may also include in the device 1 a localization system 15, of the GPS type for example, either in combination with the clock 14 or on its own, which enables the microprocessor 3 to register the position of the firearm for every fired shot in the memory 4.

In short, the above-described devices make it possible to detect and record the shots fired, possibly also to make a distinction between the blank and live cartridges fired, and to continuously analyze the kinematic behavior of the firearm, namely by measuring the recoil time of the moving parts, such that adjustment errors or performance drifts due to wear of the elements may be detected.

In a broader sense, the above-described devices make it possible to continuously control the use and efficiency of the firearm in real time by indicating anomalies or dangerous firing conditions to the shooter, or even by acting on the firing mechanism so as to adjust its operation, for example, so as to provoke the transition from firing with a locked bolt to firing with an open bolt, in order to avoid any spontaneous ignition of the ammunition in the chamber.

It is clear that every type of firearm is characterized by its own to-and-fro sequence of the moving parts and thus by its own acceleration signature with a succession of shocks and calm zones that are specific to the firearm and the ammunition used.

In the case of a firearm of the 'open bolt' type, the to-and-fro sequence of the moving parts takes place in the following manner:

- moving parts initially in a position close to the rear abutment, return spring compressed,
- return phase with new ammunition being supplied;
- abutment of the moving parts in front position;
- ammunition is fired;
- recoil phase of the moving parts;
- possibly rear abutment or contact with shock absorber at end of the course;
- moving parts come to a standstill in a position close to the rear abutment, return spring compressed.

Certain measures are necessary in order to manage the energy source.

The lifetime of the energy source 6 of the device 1, for example a cell, is a major acceptation criterion for the concept.

Ideally, the cell should be irreplaceable and inaccessible, and it should last the whole life through of the firearm while being small-sized.

More reasonably, it is acceptable to replace the cell during every preventive maintenance, at least in the case of military firearms which are subject to regular and programmed maintenance services.

The power consumption of the device 1 may be minimized by managing the active modes and sleep modes of the electronic circuits 16, such that the latter are only fully current-fed when necessary.

Figure 8:
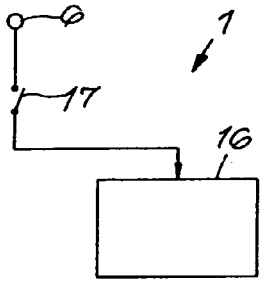

A first method, illustrated in FIG. 8, consists in placing, in series with the power supply 6 of the device 1, a switch 17 which is activated so as to close under the pressure on the trigger of the firearm.

A second method consists in using a switch 17 which is a sensor that detects when the grip is taken in hand.

The above-mentioned sensor is, for example, a capacitive sensor of the Q-Prox® type, whose constant current when in rest is in the order of about ten microampere.

A third method consists in using a switch 17 in the form of a shock sensor, activated as of a certain predetermined shock level.

This shock sensor is designed to detect any shock which may correspond to the initial impulse A of a shot being fired, and to turn on the device as soon as said shock is detected.

Figure 9:
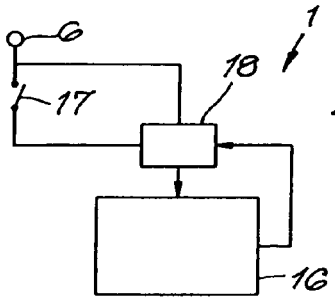

As represented in FIG. 9, the temporary closing of the sensor 17 turns on a locking circuit 18, which transmits the electric current to the circuits 16 of the device 1; the latter, once they have been activated, can then apply the algorithms for detecting and counting the shots fired to the signal S of the accelerometer.

Use is preferably made of a bidirectional shock sensor 17 which is normally open, which is only sensitive to shocks produced in one or other direction of its axis of detection, which is fixed to the firearm in such a manner that its axis of detection X-X' is parallel to the axis of the barrel Y-Y' and whose sensitivity is selected in such a manner that it will react to impulse levels corresponding to blank cartridges or live cartridges being fired.

It should be noted that it may take several milliseconds to activate the circuits 16 of the device 1, as soon as they are turned on, in which case the initial impulse corresponding to the first shock A will not be perceived.

This is no obstacle to the application of the algorithm, since the fact that the device is being charged indicates that there has been such a shock A.

However, the direction of the initial impulse of the first shock A, which makes it possible to discern between a blank cartridge and a live cartridge being fired, is not identified in this case.

Figure 10:
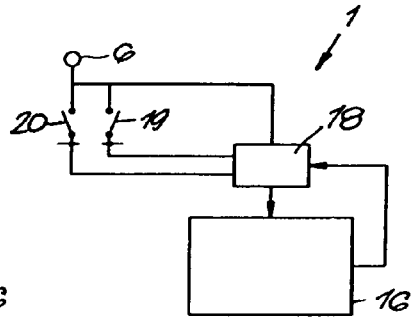

This disadvantage can be remedied by making use, as represented in FIG. 10, of two unidirectional shock sensors 19 and 20 instead of a single bidirectional sensor, and by placing them head to tail and connected in parallel, in such a manner that one sensor closes as a result of an initial impulse towards the rear of the firearm, as is the case when a live cartridge is fired, and the other closes as a result of an impulse to the front, as is the case when a blank cartridge is fired.

The locking circuit 18 of the power supply 6 only has to memorize then which of the two sensors 19 or 20 has initiated the charge to enable the microprocessor 3 of the device 1 to make the distinction.

An advantage of the device 1 shown in FIGS. 9 and 10 is that the shock sensor 17 or the shock sensors 19 and 20 may be implemented on one and the same electronic board as the accelerometer 2 and the circuits of the microprocessor 3, whereby the device 1 thus forms a stand-alone module which does not require any connections inside the firearm.

Figure 11:
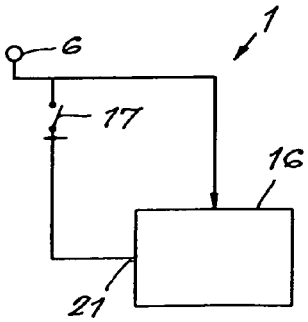
Figure 12:
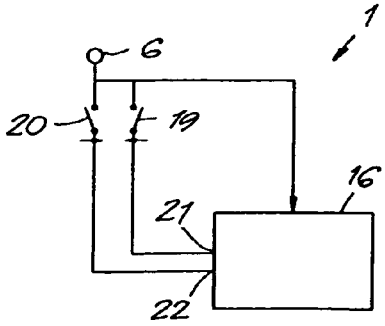

If the microprocessor 3 can be put into standby mode, in which mode it consumes very little current, for example less than one microampere, and if it does not take long to reactivate it and to get it out of said standby mode, for example a few tens of microseconds, it is advantageous to use the above-described sensors, not to turn on the device, but to wake up the microprocessor 3 out of standby mode, as illustrated in FIGS. 11 and 12.

In FIG. 11, the temporary closing of the sensor 17 activates the wake-up signal 21 of the microprocessor 3 at the interrupt input 21 of the microprocessor 3.

The special embodiment of FIG. 12 makes use of two unidirectional shock sensors 19 and 20, placed head to tail, each connected to a different wake-up signal of the microprocessor 3, for example each at two interrupt inputs 21 and 22 of the microprocessor 3 if the latter has at least two such inputs.

In this manner, the microprocessor determines, by identifying which of the two sensors has reactivated it first, the direction of the initial impulse, such that a distinction can be made between a blank cartridge and a live cartridge being fired.

Figure 13:
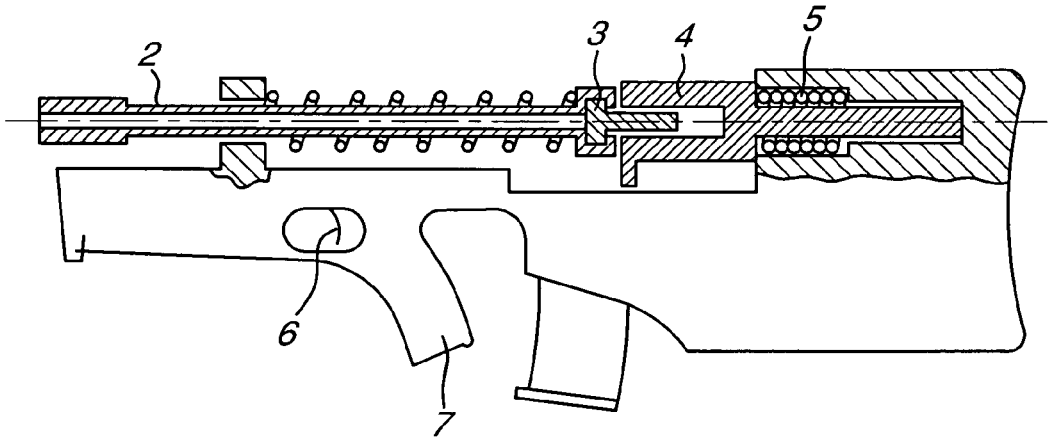

FIG. 13 illustrates barrel (2), moving parts (3, 4 and 5), trigger (6) and grip (7).

It is clear that the invention is by no means restricted to the above-described examples, but that numerous modifications can be made to the devices for detecting and counting the shots being fired by an automatic or semi-automatic firearm as described above while still remaining within the scope of the invention as defined in the following claims.

The invention claimed is:

1. Device for detecting and counting shots fired by an automatic or semi-automatic firearm, comprising:

a barrel and moving parts to recock the firearm, sliding in the axial direction of the barrel between a front position and a rear position, wherein the firearm undergoes accelerations in the axial direction of the barrel for every fired shot, caused by a succession of shocks due to the shot being fired and to the movements of the moving parts, wherein the progression in time of the accelerations is typical for a firearm and for the type of ammunition used, thus forming a typical acceleration signature for the firearm and for the type of ammunition, and including an accelerometer with a pass band which is sensitive to shocks in the axial direction of the barrel and a microprocessor for analyzing the signal of the accelerometer while firing, wherein the microprocessor is equipped with an algorithm to count the number of shots fired, based on the discernment and recording of a shot being fired on the basis of the detection, in the signal of the accelerometer, of characteristic elements of the acceleration signature which is typical of the type of firearm and of the different types of ammunition used, said characteristic elements of said acceleration signature comprising acceleration pulses, acceleration variations and calm zones during which the level of the signal of the accelerometer is practically zero, wherein the characteristic elements are defined at least by a duration, a direction, an absolute or relative amplitude, and time intervals therebetween and wherein these characteristic elements are stored beforehand in a memory of the device.

2. Device according to claim 1, wherein the algorithm to determine whether a shot has been fired is based on the occurrence of at least two shocks within an expected amplitude range and an expected direction within pre-determined time ranges which are characteristic of this type of firearm.

3. Device according to claim 1, wherein the algorithm to determine whether a shot has been fired is based on the occurrence of at least three successive shocks within an expected amplitude range and an expected direction within pre-determined time ranges separated by calm zones of pre-determined time durations which are characteristic for the respective type of firearm and during which the level of the signal of the accelerometer is practically zero, and on the fact that one of the shocks goes in the opposite direction of the other shocks.

4. Device according to claim 1, wherein if there have been three shocks, the algorithm makes it possible to measure and to memorize the time interval between the first shock and the second shock, wherein said interval corresponds to the recoil time of the moving parts of the firearm so as to allow for the diagnosis and/or the adjustment of the firearm.

5. Device according to claim 1, wherein, if there have been three shocks, the algorithm makes it possible to measure and to memorize the maximum level of the signal produced by the second shock so as to allow for the diagnosis and/or the adjustment of the firearm.

6. Device according to claim 1, wherein, if there have been three shocks, the algorithm makes it possible to calculate and to memorize the relationship between the maximum level of the signal produced by the second shock and the maximum level of the initial shock and/or the maximum level of the third closing shock so as to allow for the diagnosis and/or the adjustment of the firearm.

7. Device according to claim 1, wherein the algorithm is programmed for detecting and memorizing the absence of a part or of certain characteristic elements of the acceleration signature for one type or different types of ammunition used to indicate the malfunctioning of the firearm.

8. Device according to claim 1, wherein the algorithm makes it possible to discern the type of ammunition used, depending on whether at least a part of or certain characteristic elements of the acceleration signature correspond to the signature of the type of ammunition used.

9. Device according to claim 1, wherein the algorithm takes the direction of the first initial shock of the signature into account to make a distinction between blank and live cartridges being fired.

10. Device according to claim 1, wherein the pass band of the accelerometer is in the order of 400 Hz.

11. Device according to claim 1, wherein the algorithm makes it possible to measure the interval between the shots fired, such that the firing conditions and the rate of fire can be identified.

12. Device according to claim 11, a display indicating the programmed marginal or excessive firing conditions.

13. Device according to claim 11, including a mechanical actuator which can act on a mechanism of the firearm and which is controlled by the microprocessor so as to act on the firing mode of the firearm.

14. Device according to claim 1, including a real-time clock which enables the microprocessor to register the date of every fired shot in the memory.

15. Device according to claim 1, including a localization system enabling the microprocessor to register the position of the firearm for every fired shot in the memory.

16. Device according to claim 1 including a power supply and a switch to turn on the device or to activate a wake-up signal of the microprocessor that has a standby mode.

17. Device according to claim 16, wherein the switch is a switch that is activated by pressing a trigger of the firearm.

18. Device according to claim 16, wherein the switch is a sensor that detects when a grip is taken in hand.

19. Device according to claim 16, wherein the switch is a shock sensor which is activated as soon as a pre-determined shock level is reached.

20. Device according to claim 16, including two unidirectional shock sensors connected in parallel and placed head to tail so as to memorize the direction of the shock which has turned on the device or has put the microprocessor out of standby mode.

21. Automatic or semi-automatic firearm comprising a device according to claim 1.

* * * * *